United States Patent [19]

Kawase et al.

[11] 3,962,659

[45] June 8, 1976

[54] ELECTROMAGNETIC SWITCH

[75] Inventors: Ken-ichiro Kawase; Sadayuki Mitsuhashi; Kazutoshi Wakamatsu; Nobuo Mikami, all of Tokyo, Japan

[73] Assignee: Nippon Electric Company Limited, Tokyo, Japan

[22] Filed: Oct. 21, 1974

[21] Appl. No.: 516,334

[30] Foreign Application Priority Data

| | | |
|---|---|---|
| Oct. 20, 1973 | Japan | 48-118321 |
| Dec. 28, 1973 | Japan | 49-218 |
| Dec. 29, 1973 | Japan | 49-2004 |

[52] U.S. Cl. ..... 335/196; 200/275; 335/187

[51] Int. Cl.[2] ..... H01H 1/12

[58] Field of Search ..... 335/196, 203, 187, 192; 200/245, 275

[56] References Cited

UNITED STATES PATENTS

| | | | |
|---|---|---|---|
| 3,150,244 | 9/1964 | Nitsch et al. | 335/187 |
| 3,391,360 | 7/1968 | Hayden | 335/230 |
| 3,467,923 | 9/1969 | Woodhead | 335/196 |
| 3,826,885 | 7/1974 | Allen et al. | 200/275 |

*Primary Examiner*—Harold Broome

*Attorney, Agent, or Firm*—Sughrue, Rothwell, Mion, Zinn & Macpeak

[57] ABSTRACT

A leaf spring and contact arrangement for an electromagnetic switch. A movable contact has a magnetic body attached thereto and is restrained by side arms secured to a housing and bent arms connecting the contact member to the side arms. The side arms are arranged symmetrically about the center of gravity of the movable contact. The contact member, side arms and bent arms are all in substantially the same plane. A magnetic force overcoming the restraining force causes movement of the movable contact in a direction perpendicular to said plane. The leaf spring may be formed in a repeat pattern consisting of a plurality of movable contacts each having a pair of bent arms associated therewith for connecting the movable contact to the secured side arms.

9 Claims, 17 Drawing Figures

FIG. 1
PRIOR ART
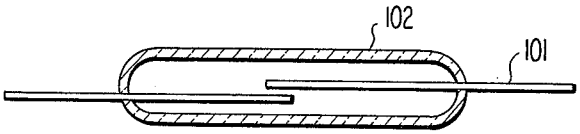
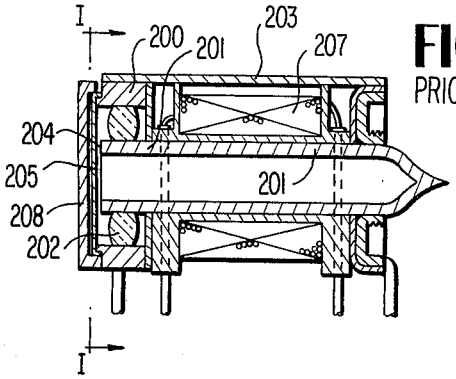
FIG. 2a
PRIOR ART
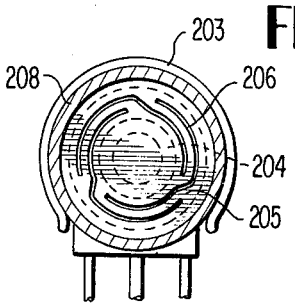
FIG. 2b
PRIOR ART
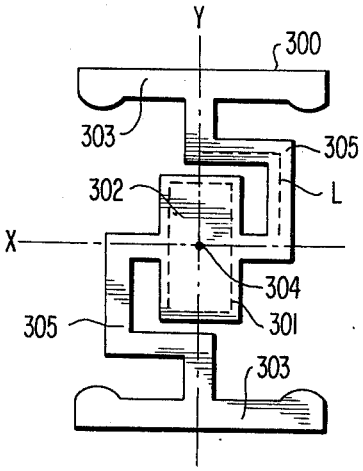
FIG. 3
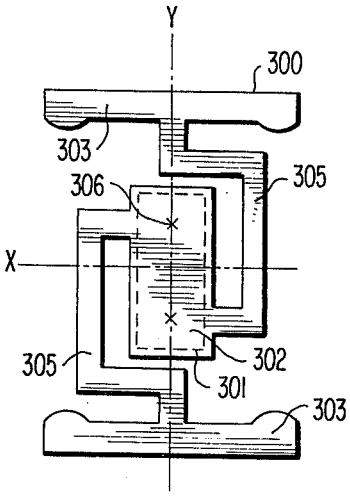
FIG. 4
FIG. 5
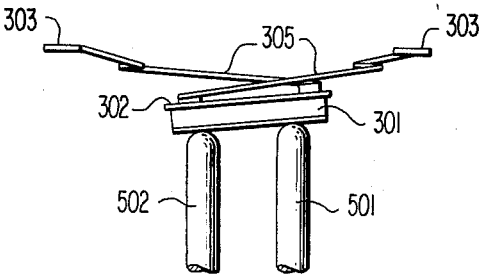
FIG. 6
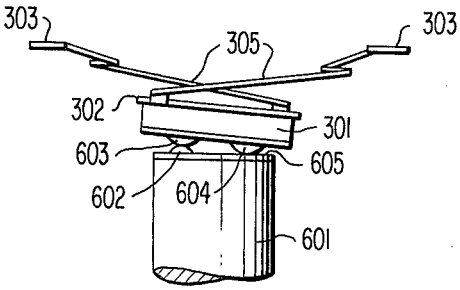

FIG. 11
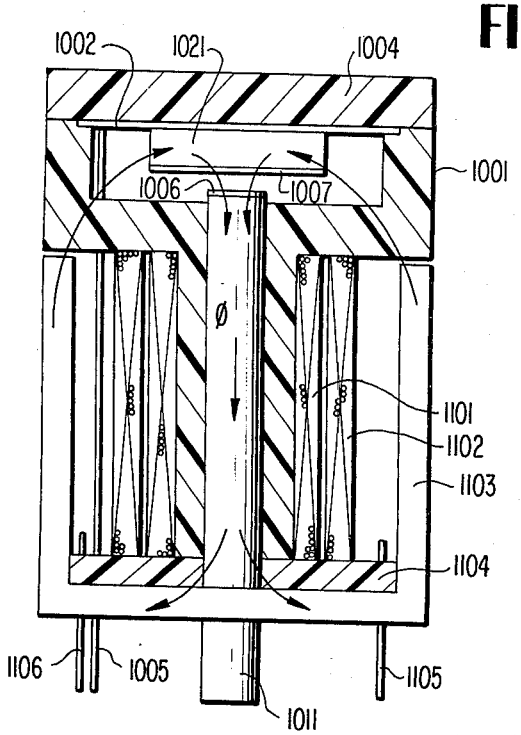
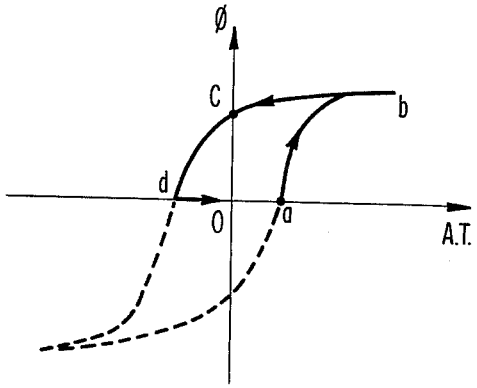
FIG. 12
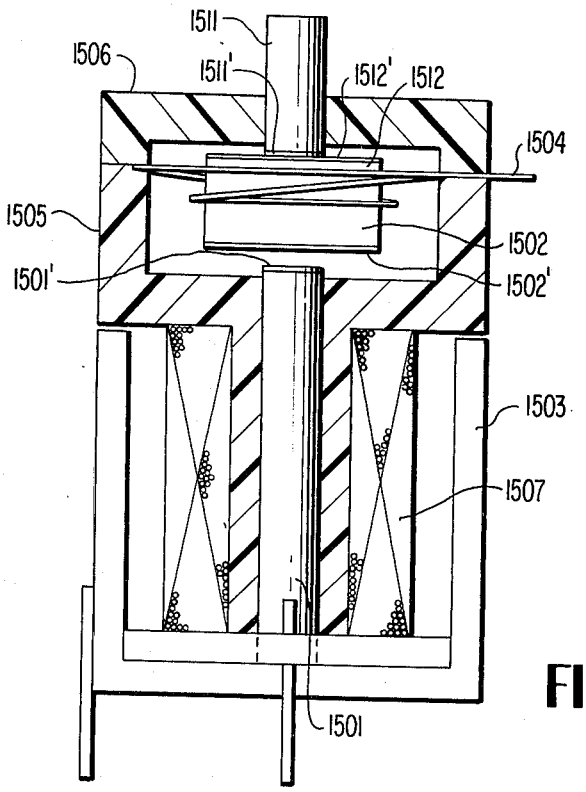
FIG. 15

ELECTROMAGNETIC SWITCH

BACKGROUND OF THE INVENTION

The present invention relates to electromagnetic switches of the type having a contact spring capable of offering gimbal effect.

A known sealed type contact element is, for example, a reed switch as shown in FIG. 1. This reed switch is of the construction wherein a pair of magnetic metal reeds 101, opposite to each other, are sealed in a glass capsule 102. These reeds function both as springs to restore their contacts into their original positions and as magnetic circuits to cause their contacts to attract each other. The reed switch has been required to operate with high sensitivity. To this effect, the stiffness of the reeds should be as low as possible. One method to meet this requirement is to extend the length of the reed or to reduce the thickness of the reeds at least in part. In practice, however, the thinning of the reeds tends not only to cause the reeds to be deformed by external mechanical force but also to weaken its attractive force. While in order to minimize the size of the reed switch, it is necessary to minimize length and diameter of the reeds. This may result in making the contact force and the retractile force lower. Still further, the process of enclosing the reeds into the glass capsule accounts for a greater portion in the production of reed switches.

Another problem is that when a switch matrix is constituted of reed switch elements, the use of a large number of constituent components is required and the overall construction becomes intricate, resulting in high manufacturing cost.

Another known sealed type relay is described in the U.S. Pat. No. 3,331,040, in which the relay employs annular contacts which may be closed by a resilient diaphragm. This relay, as shown in FIG. 2, comprises a nickel-iron tube 201 provided as an inner magnetic member, a mild steel annulus 200 installed concentrically with the tube 201 and electrically insulated from the tube 201 by a glass member 202, an outer magnetic member 203 constituted of a yoke, and a disk-shaped resilient diaphragm 205 secured to the mild steel annulus 200 at its periphery by means of a metal end cap and installed opposite a cooperating end face 204 of the inner magnetic tube 201 by way of a gap. A plurality of arcuate slots 206 are disposed on the diaphragm 205 to give the diaphragm 205 suitable elasticity. The diaphragm 205 and the tube 201 are of both electrically conductive structure. Thus, when a coil 207 is energized, diaphragm 205 makes contact with the tube 201 at the end face 204.

This type of relay, however, is likely to be deformed when it is secured in position because the diaphragm 205 is supported at one side, like in a cantilever structure. Furthermore, because the diaphragm 205 is disk-shaped and hence occupies a fairly large area, the pitch between two diaphragms becomes too large when a plurality of them are disposed on a plane. Accordingly, such a relay is hardly practical for some applications, such as a switch matrix for a speech path.

Other drawbacks of the metal sealed type switch are:

a. The metal case serves as part of the signal line, causing stray capacity, which makes high speed signal transmission difficult;

b. When glass is used for insulation and sealing, the part where the glass is welded must be maintained at a high temperature for about 10 minutes, thereby raising the cost of production;

c. The high temperature required when fusing glass serves to deteriorate the magnetic characteristics of the core. For example, the magnetic characteristics of the core of Fe-Co-V medium-hard magnetic alloy will be deteriorated by about 20% in terms of residual flux and about 30% in terms of coercive force when the core is maintained at a glass fusing temperature of 650° C for about 10 minutes; and d. Because the case is made of metal, it is very difficult to realize a construction in which signal lines of a dual wire system, such as a two-wire or four-wire system, are insulated from each other and installed within one case. Accordingly, when such switch is used for a speech path in a telephone switching system, the arrays of the switch matrix becomes complicated.

SUMMARY OF THE INVENTION

Therefore, an object of the invention is to provide a sealed type electromagnetic switch which is large in contact force, simple in construction, comprised of a minimum number of constituent elements, and markedly low in the cost required for the sealing process.

Another object of the invention is to provide a sealed type electromagnetic switch which is operable over a wide signal band.

Still another object of the invention is to provide a sealed type electromagnetic switch of a construction which permits the use of dual signal lines in one sealed container.

The other objects, features and advantages of the invention will become more apparent from the following detailed description taken in conjunction with the accompanying drawings.

BRIEF DESCRIPTION OF THE DRAWINGS

FIG. 1 is a sectional view showing the construction of a conventional reed switch.

FIGS. 2(*a*) and (*b*) are sectional views showing the construction of a conventional electromagnetic relay.

FIGS. 3 and 4 are plan views showing single contact springs embodying the invention, FIGS. 5 and 6 are perspective views showing single contact leaf springs of the construction offering gimbal effect according to the invention.

FIG. 11 is a sectional view for illustrating the operation of the switch shown in FIG. 10.

FIG. 12 is a graphic diagram showing the magnetization characteristic of the core of the switch shown in FIG. 10.

FIG. 15 is a sectional view showing a switch which constitutes a transfer contact arrangement according to the invention.

DETAILED DESCRIPTION OF THE PREFERRED EMBODIMENT

Figure 7:
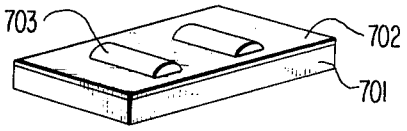
FIG. 7 is a perspective view showing a moving contact of the twin contact structure embodying the invention.

With reference to FIG. 3, a plan view is shown to illustrate an electromagnetic switch embodying the invention, which comprises: a square, electrically conductive leaf spring 300; a contact portion 302 formed in the center of the leaf spring 300 and holding a magnetic substance 301; a pair of mutually opposite side-portions 303 located aslant above and below the contact portion 302; and a pair of bent arm portions 305 being symmetrical with each other about the center of gravity 304 of the contact portion 302 and connecting the contact portion 302 to the side portions 303. The center of gravity 304 is located at the intersection of axial lines X and Y of the leaf spring.

This contact leaf spring has its contact portion 302 supported by the two side portions 303, thus eliminating possibilities of deforming the leaf spring when secured in postion. Furthermore, the effective length L of the arm portion 305 is extended owing to its being bent, which reduces the stiffness of the contact portion in the thickness direction and ensures the socalled gimbal effect to allow the contact portion to be flexibly moved with respect to the plane of the spring. Further, the contact leaf spring is in the shape elongated in the vertical direction to make it possible to arrange a plurality of such switch elements at a suitable pitch in the lateral direction. In addition, the material waste is minimized by continuously processing the strip-shaped leaf spring, to enable electromagnetic switches to be produced on a low-cost mass production basis.

One modification from the above embodiments is shown in FIG. 4 wherein the bent arm position 305 is extended on the side of the rectangular contact portion 302, thereby elongating its effective length and thus reducing the stiffness and increasing the gimbal effect. In this structure, the armature magnetic body 301 is secured to the contact portion 302 by welding, at the intersection 306 of the axis Y passing through the center of gravity 304 of the contact portion 302 and the axial extension of the arm portion 305 on the side of the contact portion. By this arrangement, the bend or the variation in the spring load of the arm portion 305 when operated is minimized and the switch operation is stabilized.

Referring to FIGS. 5 and 6, there are shown perspective views to illustrate the gimbal effect at the contact portion 302 of the foregoing leaf spring of the invention. FIG. 5 shows the make-contact state wherein the contact portion 302 which supports the magnetic body 301 of the leaf spring 300 is attracted by the core (not shown) to provide an electrical conducting path between two mutually opposing fixed contact conductors 501 and 502. As shown in FIG. 5, the moving contact portion readily tilts due to the gimbal effect and comes into contact with the two fixed contacts even if there is a step between the conductors 501 and 502 at their top contact faces. Also, as shown in FIG. 6, even if foreign matter 602 such as soil and dust particles is deposited on a fixed contact face 605 of a core 601 which faces the moving contact, the moving contact portion can establish contact, at least partly, with the fixed contact owing to the gimbal effect. In the structure shown in FIG. 6, two projections or dots 603 and 604 are disposed on the side of the movable contact to obtain the so-called twin-contact effect whereby the make-contact action is secured by at least one of the projections, e.g., the projection 604.

Referring to FIG. 7, there is shown a perspective view illustrating an example of a movable contact comprising a twin-contact structure. An armature 701 made of magnetic material is fitted with a contact metal 702 by bonding or plating. The wire projections 703 are formed on plate 702 by press and, at the same time, the projections are crown-finished. The entire process is so simple that the movable contact of the twin-contact structure can easily be manufactured on a mass production basis. In this construction, annular projections may be formed instead of the twin projections.

The examples of the electromagnetic switch described thus far are chiefly of the type having single-contact leaf spring. However, the electromagnetic switch of the invention may be constructed to have a multicontact leaf spring consisting of a repeat pattern of the foregoing single-contact leaf spring.

Figure 8:
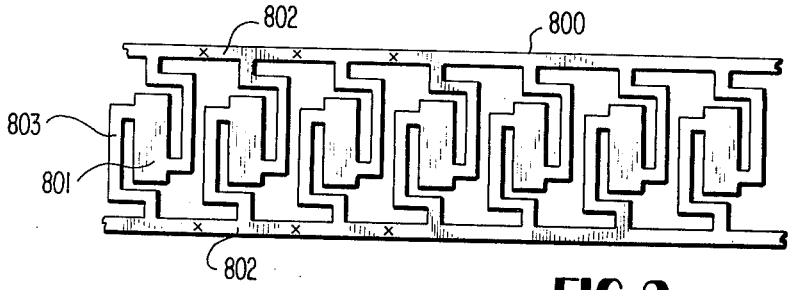
FIGS. 8 and 9 are plan views showing examples of multicontact plane leaf springs realized according to the invention.

Referring to FIG. 8, there is shown in plan view a multicontact plane leaf spring, which is formed by repeating at a regular pitch the pattern of the contact leaf spring shown in FIG. 4. A band of conductive leaf spring 800 has continuous side portions 802 by which individual contact portions 801 are supported on the same plane by way of arms 803. The contact portions 801 are supported at x-marked points.

Figure 9:
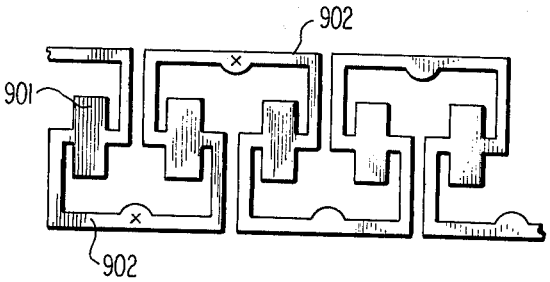

FIG. 9 shows in plan view another embodiment of the invention wherein contact patterns are alternated and side portions 902 are alternated accordingly, thus reducing the stiffness of the spring of the unit area. The contact portions 901 are supported at x-marked points.

The multicontact leaf spring of the construction, shown in either one of FIGS. 8 and 9, is advantageous in that the individual contact springs can be secured in position all at a time and hence the number of mounting steps is markedly reduced. Furthermore, because the contacts are in the same plane, the gaps to be provided between the individual contacts can be made uniform when the contact springs are assembled into a switch system. This virtually obviates the need for gap adjustment on switch contacts.

Figure 10:
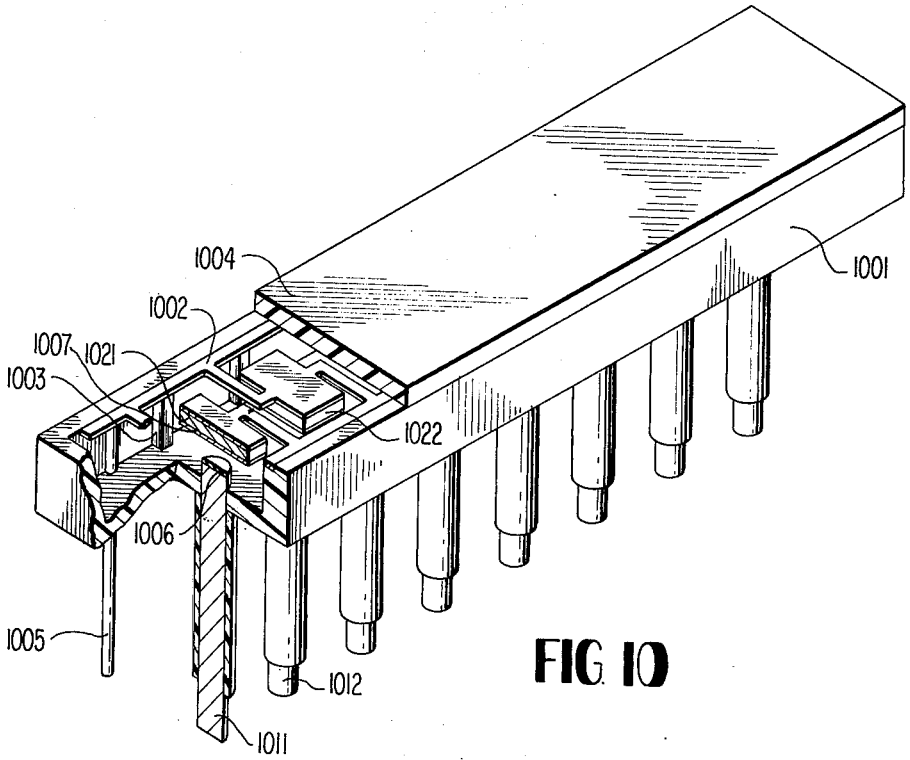
FIG. 10 is a perspective view showing a single-wire system multicontact switch of the invention with a part removed.

Referring to FIG. 10, a perspective view is shown to illustrate another embodiment of the invention offering one form of a multicontact sealed switch incorporating the multicontact leaf spring shown in FIG. 8. A group of cores 1011, 1012, . . . are inserted into a case 1001 of synthetic resin while it is being formed or after it is formed. A fixed contact portion 1006 is bonded by plating, welding or the like to each of the end faces of the cores 1011, 1012, . . . inside the case 1001. Thus, a group of cores 1011, 1012, . . . constitute fixed contacts and signal conductors. A contact spring 1002 has a group of armatures 1021, 1022, . . . each fitted with a moving contact portion 1007 at the end face by plating, welding or the like. The contact spring 1002 is secured to a support 1003 provided inside the case 1001 so that the moving contact portions 1007 face the fixed contact portions 1006 by way of a constant insulation gap. Then a cap 1004 of synthetic resin is fitted on the case 1001 by ultrasonic welding, thermal pressing or the like. The contact spring 1002 is connected to a terminal 1005 for external connections.

In this embodiment, when the coil bobbins are formed with the case 1001, the other conventional coil bobbins may be dispensed with, thus reducing the number of constituent components.

Referring to FIG. 11, there is shown a sectional view illustrating the contact operation of the multicontact sealed switch shown in FIG. 10. In the normal state, as shown in FIG. 11, there is a given insulation gap between the moving contact portion 1007 secured to the armature 1021 and the fixed portion 1006 secured to the core 1011 because of the restoring force of the contact spring 1002. Assume that an exciting current flows through a select coil 1101 which drives the switch. The resultant main flux passes through the core 1011, yoke 1103, and armature 1021, to cause attractive force greater than the restoring force of the contact spring 1002. The armature 1021 is attracted by the core 1011, thereby making contact. If the core 1011 is made of soft magnetic material, the flow of current through the coil maintains the make-contact state, which continues until the current is stopped. If the core 1011 is made of semi-hard magnetic material or of a permanent magnet, the contacts can be kept closed magnetically by the residual flux of the core 1011 which maintains an attractive force greater than the restoring force of the contact spring 1002. When a current is supplied to a reset coil 1102 in such a manner to cause reverse excitation with respect to the prior current in selecting coil 1101, the resultant flux cancels the residual flux of the core 1011 to allow the contact to break by the restoring force of the contact spring 1002, whereby the original state is restored. In FIG. 11, the numeral 1104 denotes a terminal board made of insulating material, and 1105 and 1106 denote terminals for the coils.

FIG. 12 is a graph diagram showing the magnetization characteristic of the core 1011 made of semi-hard magnetic material, wherein the flux of the core 1011 is plotted along the ordinate and the excitation ampere turn is plotted along the abscissa. When an exciting current flows through the select coil 1101, the magnetization curve runs from point O through point a to point b where the contact makes. Then, when the flow of current is stopped, the flux remains at point c, effecting magnetic latching. When an exicting current is supplied in the reverse direction, the magnetization curve passes through point *d* and returns to point O. As long as this principle is satisfied, the core 1011 and armature 1021 may be constituted of the combination of any magnetic materials, and reliable contact operature is ensured.

Figure 13A:
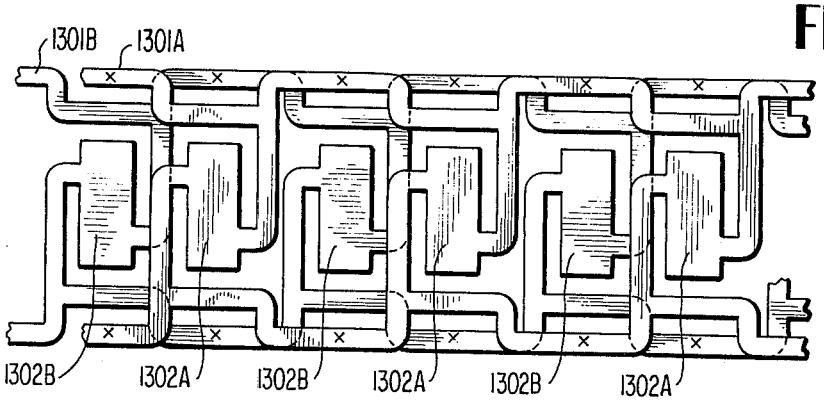
FIGS. 13(*a*) and 13(*b*) are a plan view and a frontal view, respectively, showing the construction of a contact spring incorporated in a multicontact switch of a two-wire system according to the invention.
Figure 13B:
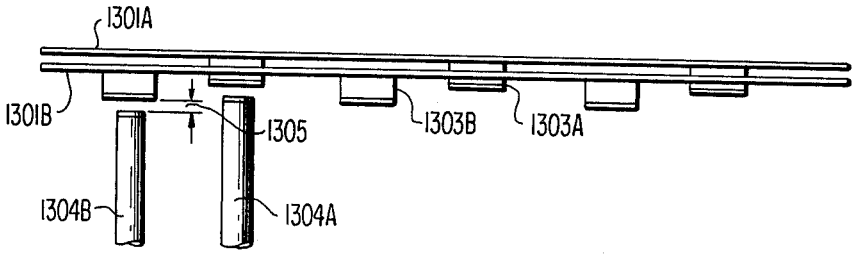
Figure 14:
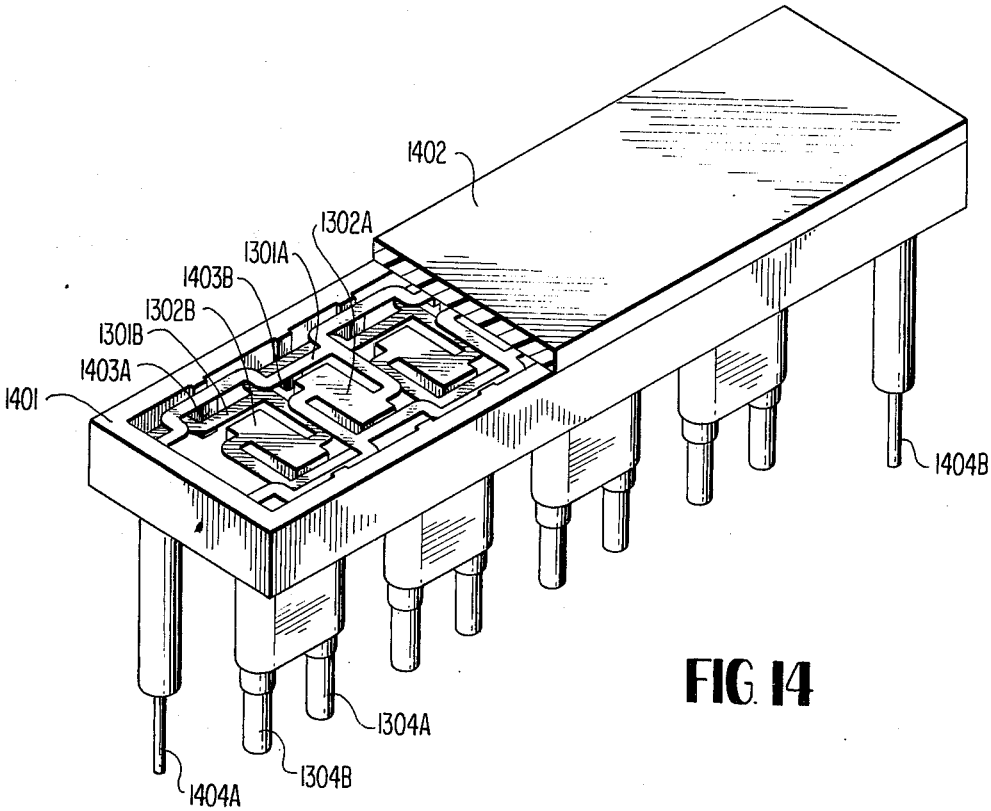
FIG. 14 is a perspective view showing the construction of a twowire system multicontact switch of the invention with a part removed.

The foregoing multicontact switch is of single-wire system. Instead, according to the invention, a multicontact switch of two-wire system can be realized by providing multicontact leaf springs in the following manner. FIGS. 13 and 14 schematically illustrate examples of the construction of the contact spring of such switch. Two pieces of multicontact leaf springs 1301A and 1301B are provided for lines A and B, respectively. These springs are formed in the same continuous pattern wherein contact portions 1302A and 1302B are supported at x-marked points and secured in position so that a given step or vertical spacing is maintained between the A and B leaf springs, and a half-pitch distance in the horizontal direction is maintained between mutually adjacent contact elements on the leaf springs combined, as shown in FIG. 13(*a*)(*b*). Contact portions 1303A and 1303B face fixed contacts 1304A and 1304B of the cores via constant gap 1305 corresponding to the step between the contact springs 1301A and 1031B. In FIG. 14, a group of core fixed-contacts 1304A, 1304B, . . . are thrusted into a case 1401. Contact springs 1301A and 1031B having contact portions 1302A, 1302B, . . . are mounted on supports 1403A and 1403B in the case 1401 so that the fixed contacts 1304A, 1304B, . . . face the moving contacts 1302A, 1302B, . . ., respectively. Then a cap 1402 is fitted on the case 1401 by welding or the like. The contact springs 1301A and 1301B are connected to terminals 1404A and 1404B, respectively, for external connections.

Referring to FIG. 15, there is shown a sectional view of a transfer contact arrangement with its drive coil part and synthetic resin part removed, to illustrate another embodiment of the invention. A core 1501 having a fixed contact portion 1501' is thrusted into a case 1505 made of electrically insulative synthetic resin either while the case is being formed or after it is formed. By this process, the core 1501 and the case 1505 are constituted into an integral body. Armatures 1502 and 1512 having moving contact portions 1502' and 1512' at their end faces are secured by welding or the like to both sides of a contact spring 1504 in the shape offering gimbal effect. These armatures are mounted in the case 1505 so that one of the moving contact portions, 1502', faces the fixed contact portion 1501' via a given insulating gap. A metal conductor 1511 having another fixed contact portion 1511' at the end face is thrusted into a cap 1506 made of electrically insulative synthetic resin while the cap is being formed or after it is formed. Thus, the metal conductor 1511 and the cap 1506 are constructed into an integral body. The cap assembly is hermetically bonded to the case 1505 by ultrasonic welding or thermal pressing or the like so that the moving contact portion 1512' establishes contact with the fixed contact portion 1511' at a suitable contact pressure in the normal state. If may be so arranged that a terminal is thrusted into the case 1505, to which terminal the contact spring 1504 is connected for the signal line of the moving contact. Instead, part of the contact spring 1504 is led out of the case for the connection to the signal line. The latter process is easier to fabricate.

This switch operates in the following manner. In the normal state, the moving contact portion 1512' is in contact with the fixed contact portion 1511' of the metal conductor 1511 whereby a break-contact is established. When an exciting current is supplied to a drive coil 1507, the armature 1502 is attracted by the core 1501 to make contact with the moving contact portion 1502' and fixed contact portion 1501'.

In this embodiment, a plurality of cores, armatures and metal conductors may be suitably disposed to form a one-dimensionally spread contact spring. The use of such contact spring will make it possible to realize a contact switch in which many switch elements are hermetically enclosed.

As has been described above, the invention provides electromagnetic switches of the type comprising a single contact leaf spring being low in stiffness, free of deformation, high in contact reliability, offering gimbal effect, constructed into a small size, manufacturable at low costs, and applicable to switch matrix. According to the invention, a multicontact plane leaf spring can be realized by repeatedly forming the pattern of the single contact leaf spring on a band of conductive leaf spring. This multicontact leaf spring, when applied to a multicontact switch, assures high contact reliability. The multicontact leaf spring of the invention can be used as a common wire for the signal terminal. Hence, the use of the multicontact leaf spring contributes much to the reduction of production cost and the assembly cost as well. According to the invention, a plurality of cores and the case made of synthetic resin can be constructed into an integral body, which enables a large number of switch elements to be enclosed into a case which is hermetically sealed, and serves to lower the overall production cost. Furthermore, the insulation inside the case can be ensured and thus the signal frequency bandwidth can be widened. Still further, the multicontact leaf spring of the invention facilitates dual system contact connections and is applicable to a switch matrix used in a telephone switching system.

What is claimed is:

1. An electromagnetic switch including movable and fixed contacts, one of said contacts having a twin projection, said movable contact being suspended by a thin leaf spring capable of readily causing the movable contact to be flexibly displaced in the direction normal to the mating plane, said leaf spring comprising a contact portion having a magnetic body attached thereto, said contact portion and magnetic body in combination having a center of gravity substantially in its geometric center, a pair of side portions adapted for securing said contact portions in a housing of said electromagnetic switch, said side portions being located substantially in the plane of and on opposite sides of said contact portion, and a pair of symmetrically positioned bent arm portions, each of said bent arm portions communicating with a respective one of said side portions and a respective one side of said contact portion, said bent arm portions formed symmetrically with respect to each other about the center of gravity of said combination of contact portion and said magnetic body, whereby said combination of contact portion and said magnetic body is free to move in a direction substantially perpendicular to a plane in which said side arms are secured in response to a force overcoming the restraining force caused by said side portions and said bent arms.

2. A contact spring as claimed in claim 1 wherein said contact portion comprises a first conductive plate on one surface of said magnetic body and a second conductive plate on the opposite surface of said body.

3. A contact spring as claimed in claim 2 wherein said bent arms are integral with said first conductive plate and said side arms.

4. A contact spring as claimed in claim 3 further comprising a pair of conductive projections in said second conductive plate.

5. A multicontact leaf spring for an electromagnetic switch, said multicontact leaf spring comprising, side arms for securing said leaf spring in an electromagnetic housing, a plurality of contact portions having a magnetic body attached to each one, each said combined contact portion and magnetic body having a center of gravity substantially in its center, a plurality of pairs of bent side arms, each said pair of bent side arms being associated with a respective one of said contact portions and being formed symmetrically with respect to each other about the center of gravity of said contact portion and magnetic body and connecting said contact portion to two side arms on opposite sides and in substantially the same plane as said contact portion, said contact portions being arranged at a regular pitch in the plane of said side portions, whereby each said contact portion is free to move in a direction perpendicular to said plane in response to a force overcoming the retaining force of said respective pair of bent arms and said side arms.

6. An electromagnetic switch of the synthetic resin sealed type comprising a plurality of rod-shaped cores, each having a fixed contact portion at one end-face thereof, inserted into an electrically insulative case made of synthetic resin, a contact spring having a repeat pattern, each pattern comprising an armature having a movable contact portion at one endface connected to a terminal adapted to be connected to a signal line and mounted in said case so that said movable contact portion faces a respective one of said fixed contact portions and is separated therefrom by a given insulating gap, said case being hermetically sealed by means of a cap made of electrically insulative synthetic resin, and a yoke installed in a position adjacent each said core.

7. An electromagnetic switch of the synthetic resin sealed type as claimed in claim 6 wherein said cores and said case are formed into an integral cylindrical capsule for use as a bobbin on which a drive coil is wound.

8. An electromagnetic switch of the synthetic resin sealed type as claimed in claim 6 further comprising a second contact spring substantially identical to said first contact spring and being positioned in said case such that each movable contact portion of said second contact spring is adjacent and slightly below the plane of an associated one of said contact portions of said first contact switch, and said associated contact portions of said first and second contact springs being positioned at a half pitch distance therebetween in the direction of said repeat pattern.

9. An electromagnetic switch of a synthetic resin sealed type comprising a plurality of rod-shaped cores, each having a fixed contact portion at one end-face, inserted in a case made of electrically insulative synthetic resin, a plurality of armatures each having a movable contact portion at one end-face secured to both surfaces of a contact spring having a repeat pattern, said contact spring being connected to a terminal adapted to be connected to a signal line and mounted in said case which is hermetically sealed so that the movable contact portions on one surface of said contact spring face the fixed contact portions by way of given insulating gaps, said movable contact portions on the other surface thereof being in contact with fixed contact portions provided on end-faces of a plurality of conductors which are thrusted into a cap made of electrically insulative synthetic resin, and a yoke disposed adjacent each said core.

* * * * *